US011035547B2

(12) United States Patent
MacAllen et al.

(10) Patent No.: US 11,035,547 B2
(45) Date of Patent: Jun. 15, 2021

(54) DIFFUSE LIGHTING DEVICES

(71) Applicant: MOLO DESIGN, LTD., Vancouver (CA)

(72) Inventors: Todd P. MacAllen, Vancouver (CA); Stephanie J. Forsythe, Vancouver (CA)

(73) Assignee: MOLO DESIGN, LTD., Vancouver (CA)

( * ) Notice: Subject to any disclaimer, the term of this patent is extended or adjusted under 35 U.S.C. 154(b) by 28 days.

(21) Appl. No.: 16/778,218

(22) Filed: Jan. 31, 2020

(65) Prior Publication Data

US 2020/0248886 A1 Aug. 6, 2020

Related U.S. Application Data

(60) Provisional application No. 62/799,389, filed on Jan. 31, 2019.

(30) Foreign Application Priority Data

Feb. 11, 2019 (CA) ..... CA 3033389

(51) Int. Cl.
*F21V 3/02* (2006.01)
*F21V 17/10* (2006.01)

(52) U.S. Cl.
CPC ..... *F21V 3/02* (2013.01); *F21V 17/105* (2013.01); *F21V 17/108* (2013.01)

(58) Field of Classification Search
CPC ..... F21V 3/02; F21V 17/105; F21V 17/108
See application file for complete search history.

(56) References Cited

U.S. PATENT DOCUMENTS 4,275,434 A * 6/1981 Borowitz ..... F21S 8/06 362/311.01
8,561,666 B2 * 10/2013 MacAllen ..... E04B 2/7405 160/84.05
9,309,668 B2 4/2016 MacAllen et al.
9,394,686 B2 7/2016 MacAllen et al.
9,797,134 B2 10/2017 MacAllen et al.
2009/0103314 A1 * 4/2009 Hammer ..... E04B 9/303 362/351
2010/0186905 A1 * 7/2010 MacAllen ..... E04B 2/7401 160/127
2015/0225113 A1 * 8/2015 Lungu ..... G10K 11/002 181/198
2015/0309563 A1 * 10/2015 Connor ..... G06F 3/017 73/865.4

(Continued)

*Primary Examiner* — Donald L Raleigh

(57) ABSTRACT

Light fixtures often have bright spots caused by the light sources that can be unpleasant or uncomfortable to look at. A light device is provided that diffuses the light, which includes an internal cavity defined in the body of a flexible shroud extending transversely from an opening defined in a first end frame to an opening defined in a second end frame of the shroud. The first and the second end frames are removably connectable to each other to form a circular configuration of the flexible shroud. The internal cavity also extends in the circular configuration. A light board is attached to one of the end frames and at least partially covers the opening of the given end frame. In the circular configuration, the light board is sandwiched between the first and the second end frames.

40 Claims, 12 Drawing Sheets

(56) References Cited

U.S. PATENT DOCUMENTS

| | | | | |
|---|---|---|---|---|
| 2016/0003417 | A1* | 1/2016 | Bukkems | H05K 1/189<br>362/236 |
| 2016/0045760 | A1* | 2/2016 | Tapper | A61N 5/0616<br>607/90 |
| 2017/0040306 | A1* | 2/2017 | Kim | H05K 1/181 |

* cited by examiner

DIFFUSE LIGHTING DEVICES

CROSS-REFERENCE TO RELATED APPLICATIONS

This application claims priority to U.S. Provisional Patent Application No. 62/799,389, filed on Jan. 31, 2019 and titled "Diffuse Lighting Devices", and to Canadian Patent Application No. 3,033,389, filed on Feb. 11, 2019 and titled "Diffuse Lighting Devices", the entire contents of which are herein incorporated by reference.

TECHNICAL FIELD

The following generally relates to diffuse lighting devices and methods of forming these devices.

DESCRIPTION OF THE RELATED ART

Lighting devices are used to illuminate a space, such as a room. Lighting systems are a staple product used in domestic, working and public environments. Lighting systems can be hung from an overhead structure, such as a ceiling, or supported from below, such as on a table or on a floor.

Lighting devices typically include light bulbs or light emitting diodes (LEDs) that are encased in a light shade to diffuse the light. For example, a light source is typically in the middle of a light shade. These light shades can be made from cardboard, plastic, colored or stained glass, etc. Examples of light shades include lamp shades. Light shades or lamp shades are commonly used in light fixtures, pendant lights, chandeliers, hanging lights, and floor lamps.

It is herein recognized that, even with light shades, the light is not evenly distributed across the light shade. A person can see a point source of light, although its points source is somewhat diffused. Diffusing a point source of light with a light shade is even more difficult if the light shade has holes or apertures. Seeing the point source (or points sources) of light is not aesthetically pleasing and can make the eyes uncomfortable. These point sources of light are also called hot spots.

It is also recognized that lighting devices require some effort to setup, such as placing the lighting source (e.g. light bulb, LEDs, etc.) into a light shade or behind a light shade.

The above disadvantages are herein recognized.

BRIEF DESCRIPTION OF THE DRAWINGS

Example embodiments of a self-locking mechanism will now be described by way of example only with reference to the accompanying drawings in which.

DETAILED DESCRIPTION

Figure 2:
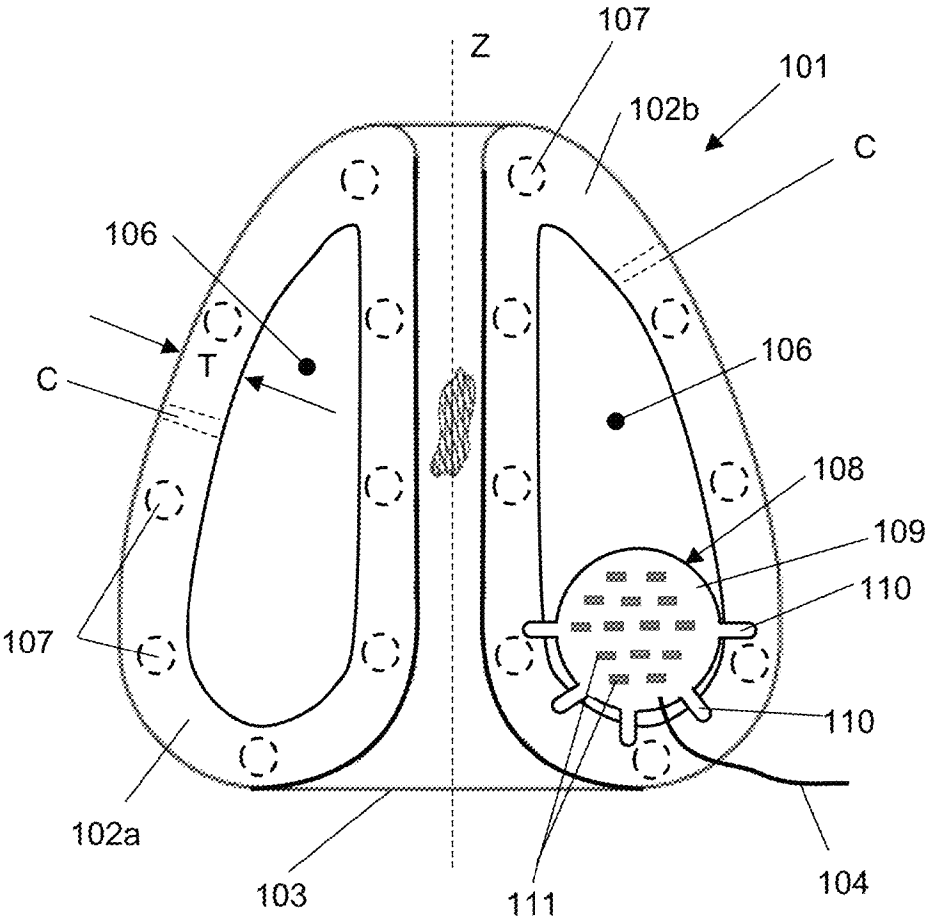
FIG. 2 is a front profile view of the lighting device shown in FIG. 1 with the flexible shroud partially collapsed to show a light board and a cavity defined in the flexible shroud.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

Figure 1:
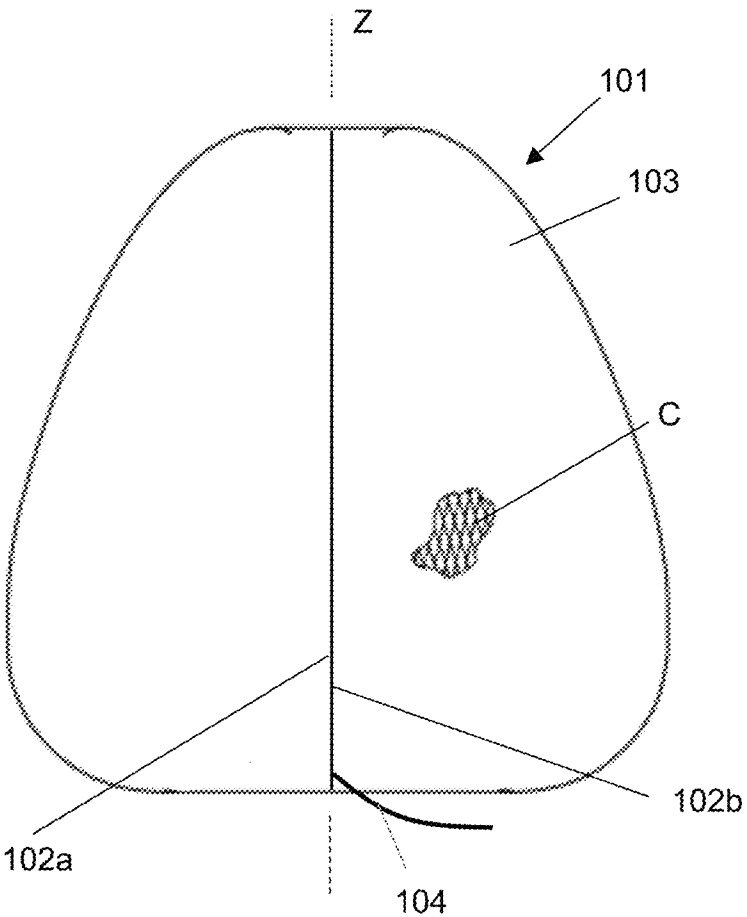
FIG. 1 is a front profile view of a lighting device showing a flexible shroud in an expanded configuration, according to an example embodiment.

Turning to FIG. 1, an example embodiment of a lighting device 101 is shown in a front profile view. The lighting device 101 includes a flexible shroud 103 that includes two end frames 102*a* and 102*b* that join together. FIG. 2 shows the lighting device 101 with the end frames 102*a* and 102*b* separated from each other, as the flexible shroud is partially collapsed to show its interior.

The flexible shroud is able to move from a collapsed state to an expanded state, in which the end frames move to join together, as shown in FIG. 1. This forms a rounded shape, like a toroid. The flexible shroud defines within it a cavity 106 that extends through the length of the flexible shroud.

When the flexible shroud is flexed so that it surrounds a vertical axis Z (e.g. as shown in FIG. 1), then the internal cavity continuously extends all the way around the vertical axis Z of the flexible shroud.

FIG. 2 shows a cross-sectional shape of the end frames 102*a*, 102*b* each having openings that lead to the cavity 106. There are fasteners 107 positioned on the end frames to hold the end frames 102*a*, 102*b* together, as shown in the circular configuration of FIG. 1. In another example, the fasteners can be used to join an end frame from a first lighting device to an end frame from a second lighting device. In this way, multiple lighting devices can be joined.

In an example embodiment, the fasteners use magnetic force to attract to each other. This allows the end frames 102*a*, 102*b* to be easily joined together (e.g. see FIG. 1) and then pulled apart (e.g. see FIG. 2). For example, magnets or magnetic materials (e.g. metals and metallics), or both, are used as fasteners. Other types of fasteners may be used, including, but not limited to: hook and loop fasteners (e.g. available under the trade name Velcro), adhesives, reclosable fasteners with mushroom-shaped heads (or other shaped heads such as clover-shaped heads) that interlock with each other, clasps, or combinations thereof.

A light board 108 is attached to one of the end frames 102*b* and it is positioned so that the light elements 111 thereon shine into the cavity 106. In the example shown, the light board 108 at least partially blocks the opening defined in the end frame 102*b*. In particular, the light board 108 is a thin board that includes a main body 109 and with tabs 110 that project from the main body 109. The tabs 110 are used to secure the light board 108 to the end frame 102*b*, such as by adhesive or a mechanical means, or both. In an example aspect, the tabs 110 and the fasteners 107 are positioned in different places (e.g. non-overlapping) from each other so that they do not interfere with each other. Light elements 111 are positioned on both of the opposite facing major sides of the main body 109 to project light into the cavity 106. An electric wire 104 is attached to the light board 108 as seen in FIG. 2, and this wire 104 runs out from the seam created when the end frames 102*a*, 102*b* are joined together as shown in FIG. 1.

In the expanded circular configuration, the lighting device may also be described as being shaped like a toroid. Similarly, the internal cavity defined within the flexible shroud is also shaped like a toroid.

The light emitted from the light board travels around the cavity due to the translucency of the flexible shroud material and due to internal reflections or refractions, or both, of the light interacting with the flexible shroud material. When the lighting device 101 is in the expanded circular configuration, the light board 108 uniformly illuminates the entire flexible shroud.

In an example embodiment, the flexible shroud has many surfaces at different angles to evenly diffuse the light. For example, the flexible shroud has an outer wall thickness T (see FIG. 2) with multiple channels C that extend through the thickness. For example, there are many channels C that are distributed throughout the entire outer wall to form a cellular structure. Light can pass through the channels C. In a further example aspect, the material of the flexible shroud is translucent, so that some light can also pass through the material that defines the channels.

In another example embodiment, the flexible shroud is a flexible article that comprises a core and a pair of end frames at opposite ends of the core. The core is formed from a plurality of panels. The panels in the core each have a pair of oppositely-directed major faces. The panels are preferably formed from a flexible flaccid material. In alternative embodiments, the panels are formed from a rigid material or semi-rigid material. The material forming the panels is a flame-retardant material that could be formed of tissue paper, a non-woven textile, or a woven textile. For example, Tyvek from DuPont could be used to form the panels. Other materials include cardboard, cardboard composites, plastics, and plastic composites. It will be appreciated that materials could be combined in different ways. Each panel has a major dimension or height and a width which may be adjusted to suit particular environments. Adjacent panels are interconnected to one another at spaced intervals that alternate across the width of the face of the panel. The connection between adjacent panels is through a series of parallel, laterally-spaced strips on the face of a given panel. The strips are defined by stripes of adhesive, or some other joining mechanism or process, which joins the adjacent panels to one another. Each of the panels is therefore alternately connected to adjacent given panels on opposite sides so that, upon extension of the panel in a horizontal direction, a cellular structure having vertical channels, which are vertical voids, is formed within the core. The voids extend vertically from top to bottom of the core with the panels providing a continuous transverse barrier. The internal cavity that extends along the length of the flexible shroud may be conveniently formed with the core in a collapsed condition by using a paper drill bit or similar device, or die cut. In an example embodiment, the flexible shroud has the characteristics of a flexible article described in U.S. Pat. No. 9,512,615, titled "Flexible Furniture System", and incorporated herein by reference.

It will be appreciated that there are different ways to form multiple channels in the flexible shroud.

In the example shown in FIGS. 1 and 2 of the lighting device in a circular configuration, channels C are oriented to face inwards towards the vertical axis Z. The side walls that define the channels visually obstruct sides view and, in turn, these side walls also fully or partially occlude a person being able to look at the light board. At many angles, as a person looks through a channel at the center (e.g. the vertical axis Z), the person cannot see the light elements from the light board directly. This provides a more pleasant viewing experience as the light is more evenly diffused.

In other example embodiments, the flexible shroud does not have channels. For example, the flexible shroud has holes or openings that allow light to pass through. In another example embodiment, the surface of the flexible shroud does not have any openings or channels and is formed from translucent material. In an example aspect, the flexible shroud has many ridges or folds or facets, or combinations thereof, that help to disperse the light evenly through refractions or reflections, or both, at different angles.

In an example aspect, to form the lighting device, the first end frame and the second end frame are joined together using the fasteners, thereby forming the circular configuration. Then the light device is turned on. In other words, there is little setup effort, or no setup effort, required. In the setup of other flexible lighting devices, by contrast, effort is used to position a lighting element in the middle of the flexible shroud, or lights are strung through or along the flexible shroud.

In an example aspect, the light board is attached to one of the frames (e.g. end frame 102*b*) and this makes the formation of the lighting device easy. Furthermore, the light board is thin, which makes transport easy. It will be appreciated that the lighting device can be collapsed to a small volume that would be similar looking to the collapsed configuration shown in FIG. 5.

It will also be appreciated that the light board is hidden from many viewing angles. Even when a person looks directly at the seam that is formed by the joining of the first frame 102*a* and the second frame 102*b*, the light board is occluded because of the thin side profile and the orientation of the light board.

In an example embodiment, the lighting elements 111 are light emitting diodes (LEDs). In another example embodiment, the lighting elements 111 are organic LEDs (OLEDs). In another example embodiment, there are multiple lighting elements on a first major face of the main body of the light board and there are multiple lighting elements on a second major face of the main body of the light board. In another example embodiment, there is one light element on the first major face of the main body, and there is one light element on the second major face of the light body. In an example aspect, the lighting elements have a thin side profile.

While many of the examples shown herein include a wire to provide electrical power to the lighting elements, in another example embodiment, one or more batteries are incorporated onto the light board to provide power to the lighting elements.

Figure 3:
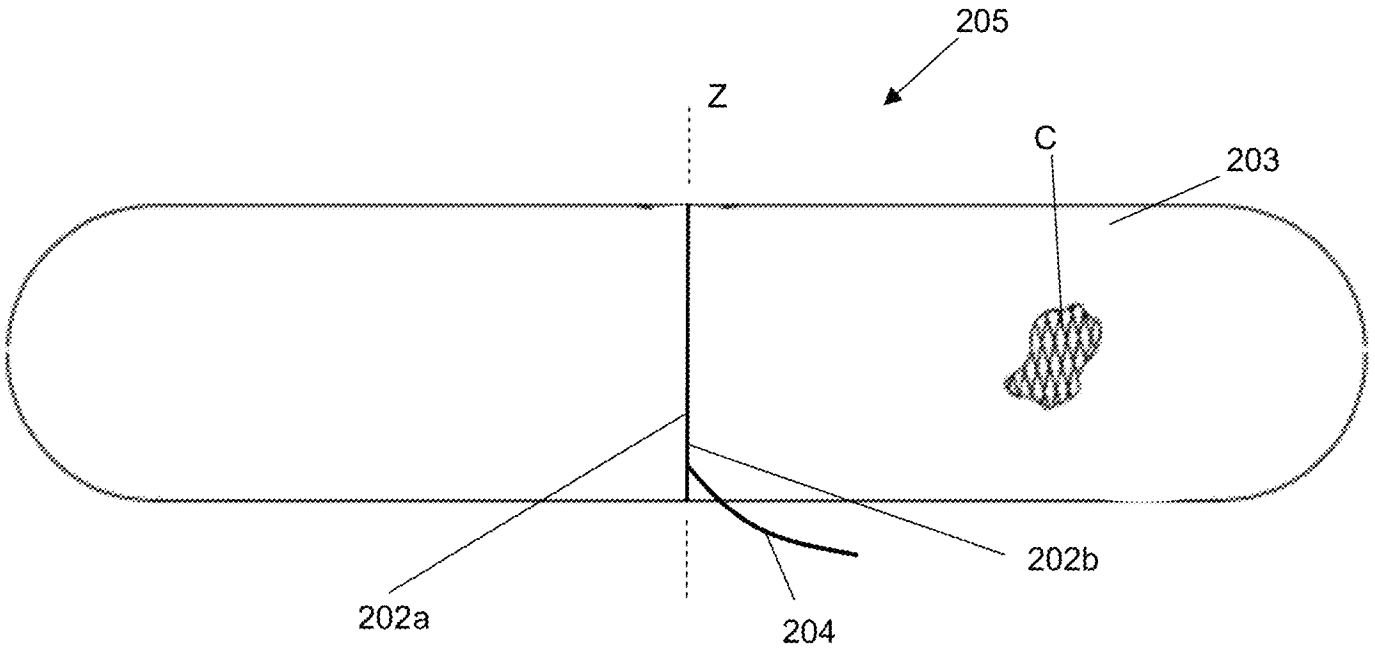
FIG. 3 is a front profile view of another embodiment of a lighting device that shows a flexible shroud in an expanded configuration, according to another example embodiment.
Figure 4:
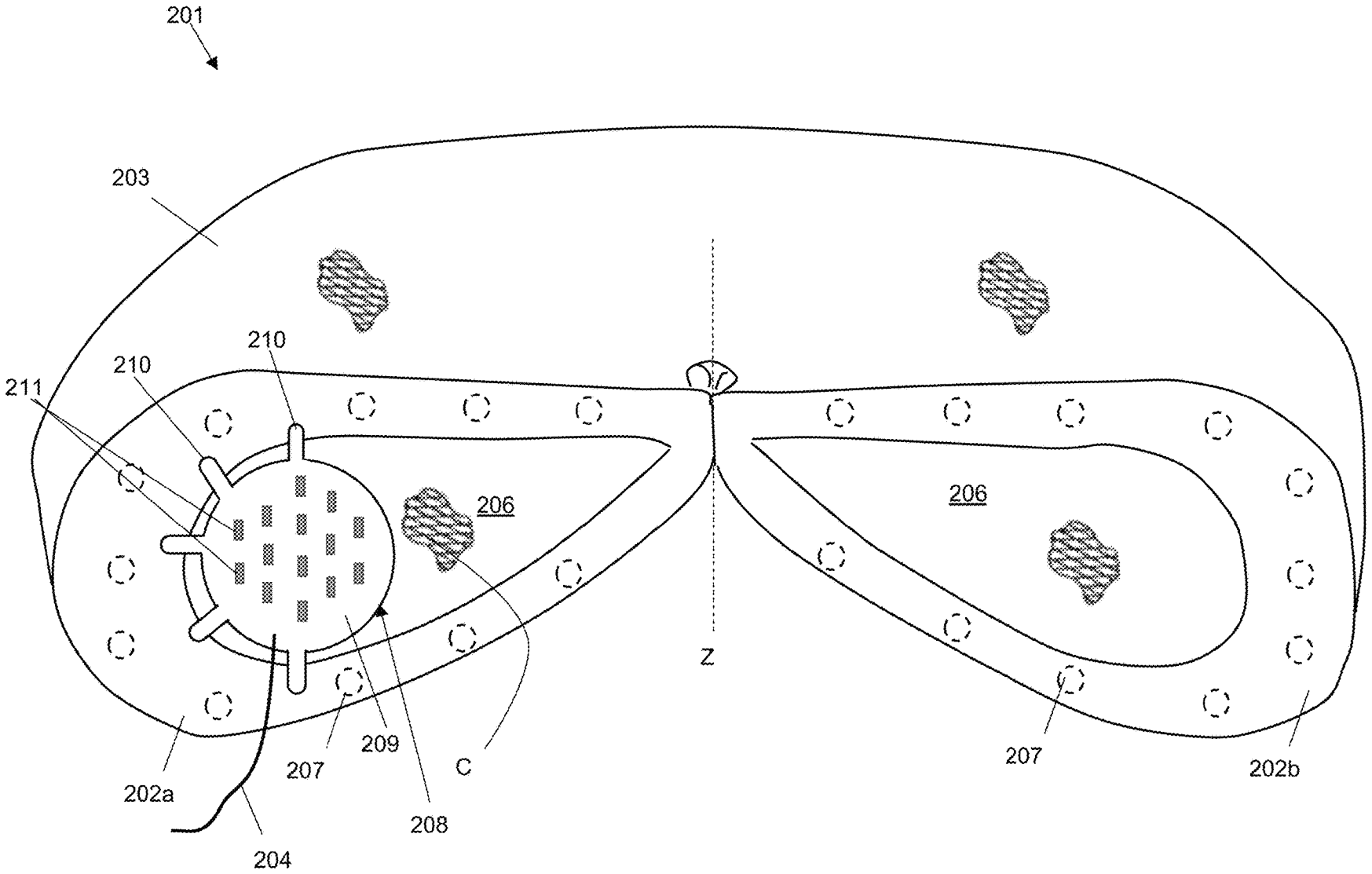
FIG. 4 is a top perspective view of the lighting device of FIG. 3 showing the flexible shroud partially collapsed to show a light board and a cavity defined in the flexible shroud.

Turning to FIG. 3 another example embodiment of a lighting device 201 is shown in an expanded configuration with the end frames 202*a*, 202*b* joined together. FIG. 4 shows the same lighting device 201 in a partially collapsed configuration with the end frames 202*a* and 202*b* moved apart from each other to better show the cavity 206 defined within the flexible shroud 203. In the expanded configuration, the flexible shroud 203 is expanded around a center vertical axis Z. The end frames 202*a*, 202*b* are held together to each other using fasteners 207. The types of fasteners can include the examples of the fasteners described above with respect to FIG. 2.

In this example, the light board 208 is attached to the end frame 202*a* using it tabs 210, which extend from the light board's main body 209. Lighting elements 211 are located on both of the major opposite faces of the main body 209.

As better seen in FIG. 4 from the top perspective view, the flexible shroud 203 includes channels C that extend upwards and downward. In other words, a person looking from below or above at the flexible shroud can look through the channels C into the cavity 206. As there are no light elements that are directly in the path of the channels, a person cannot see (or cannot easily see) the light elements on the light board. When a person is below or above the lighting device and looking at the seam where the two end frames 202*a*, 202*b* meet, a person cannot see (or cannot easily see) the light board and the light elements thereon since these are being occluded by both of the end frames 202*a*, 202*b*.

Figure 5:
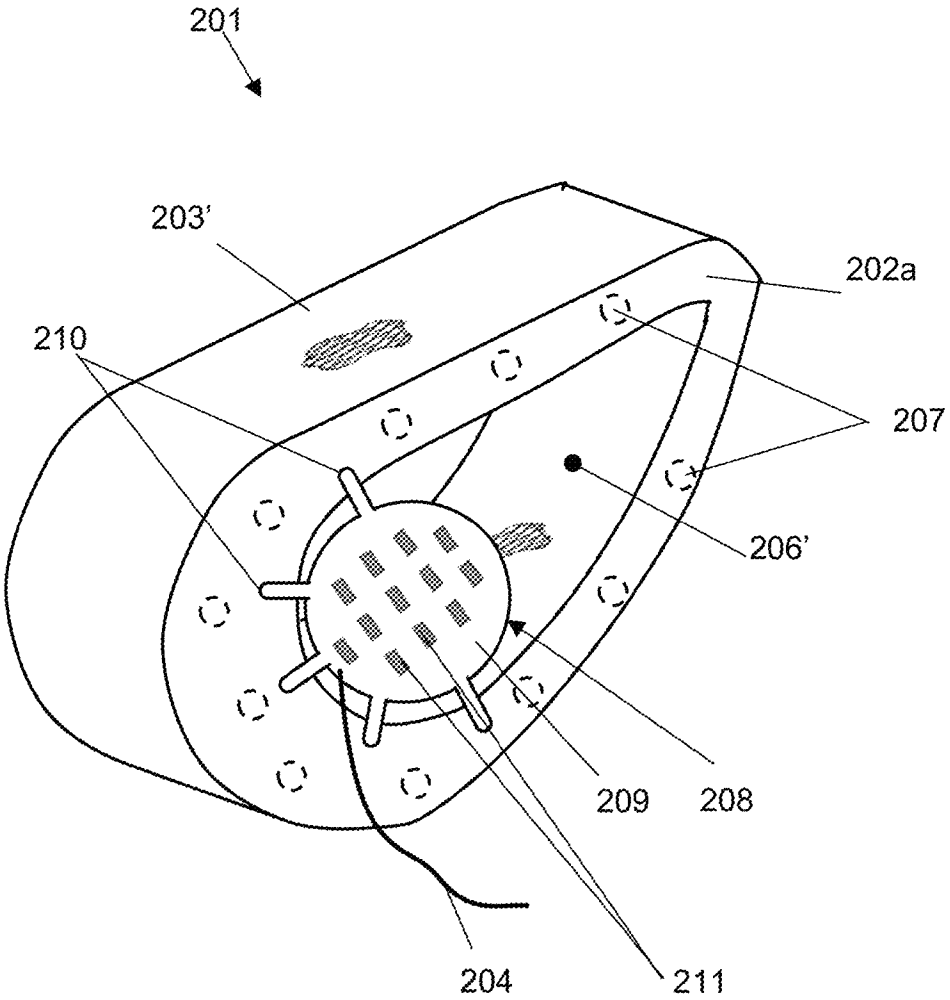
FIG. 5 is a perspective view of the lighting device of FIG. 3 showing the flexible shroud in a collapsed configuration.

FIG. 5 shows a collapsed view of the lighting device 201, with the flexible shroud in a collapsed state 203' and the cavity 206' within the flexible shroud also collapsed. The thin profile of the light board 208 adds little or an insignificant amount of width to the collapsed flexible shroud 203'. In an example embodiment where the light board is embedded within an end frame, the light board does not add any width above the surface of the end frame. This configuration of components makes the lighting device 201 very compact in the collapsed state, which is very convenient for transport.

Furthermore, it is very easy for a person to form the expanded circular light configuration from the collapsed state. The person only needs to take the two end frames and join them together using the fasteners 207. Conversely, it is very easy for a person to transform the expanded circular light configuration to a collapsed state (as per FIG. 5) by taking the two joined end frames 202*a*, 202*b* and pulling them away from each other so that they collapse backwards towards each other. No attention or effort is required to reposition or handle the light source, since in this case the light board 208 is attached to one of the end frames.

Figure 6:
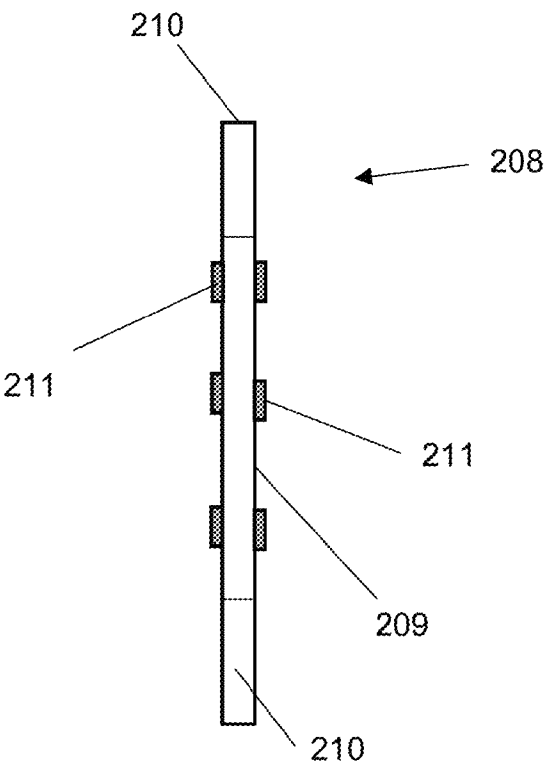
FIG. 6 is a side view of an example embodiment of a light board in isolation, showing light elements on both sides of the light board, according to an example embodiment.

FIG. 6 shows the light board 208 in isolation from a side profile view. The dimensions of the thickness are not to scale, but are shown as illustration only. In this orientation, the light board is 208 is thin, which makes it easier to be hidden by the end frames 202*a*, 202*b* and, in some cases, other surrounding flexible shroud material. On both faces of the main board 209 there are lighting elements 211.

Tabs 210 are shown and described to attach the main body 209 to a given end frame. However, it will be appreciated that other shapes and mechanisms to attach a board having light elements to a given end frame.

Figure 7A:
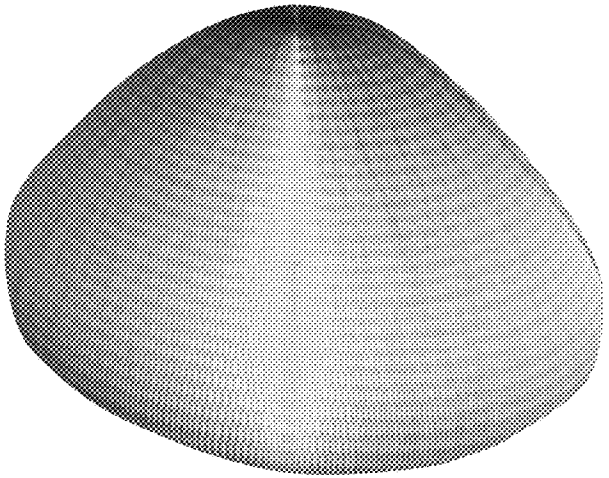
FIGS. 7A, 7B and 7C shows an example embodiment of a lighting device which has been flexed to different circular configurations.
Figure 7B:
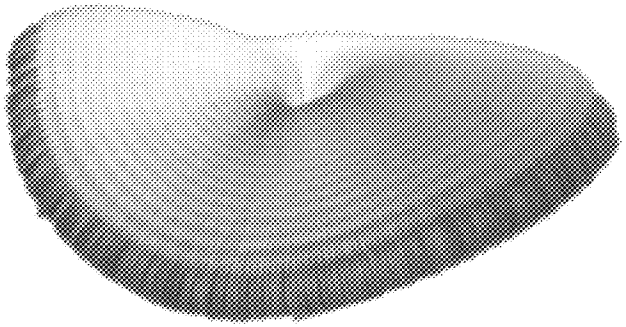
Figure 7C:
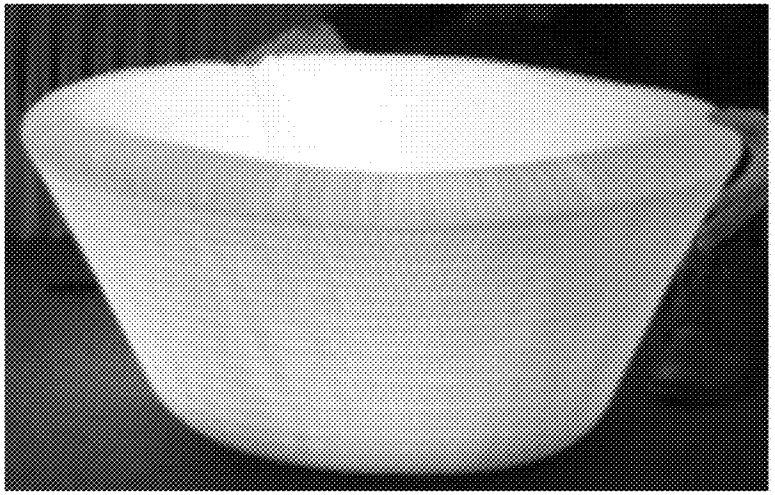

FIGS. 7A, 7B and 7C show different example shapes that can be made using the lighting device having end frame shapes that are similar to the tear-drop shape shown in FIGS. 2 and 4. In particular, the flexible shroud can be flexed to makes the different expanded circular shapes shown in FIGS. 7A, 7B and 7C.

Figure 9:
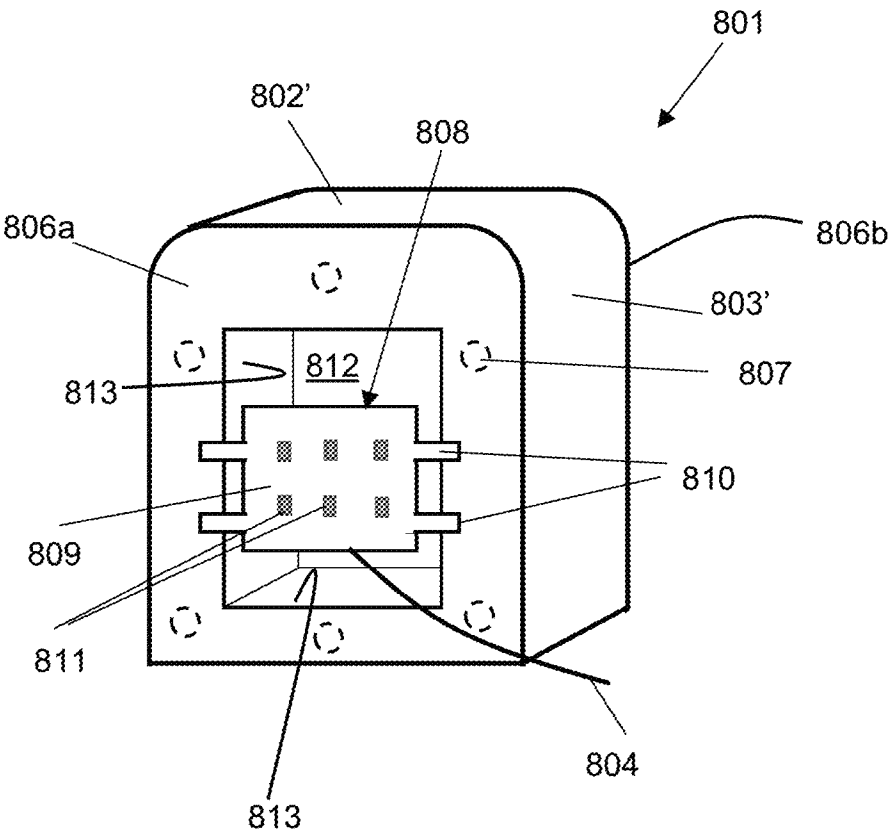
FIG. 9 is a perspective view of the lighting device of FIG. 8, showing the flexible shroud in a collapsed configuration, a light board, and a cavity defined within the flexible shroud.
Figure 8:
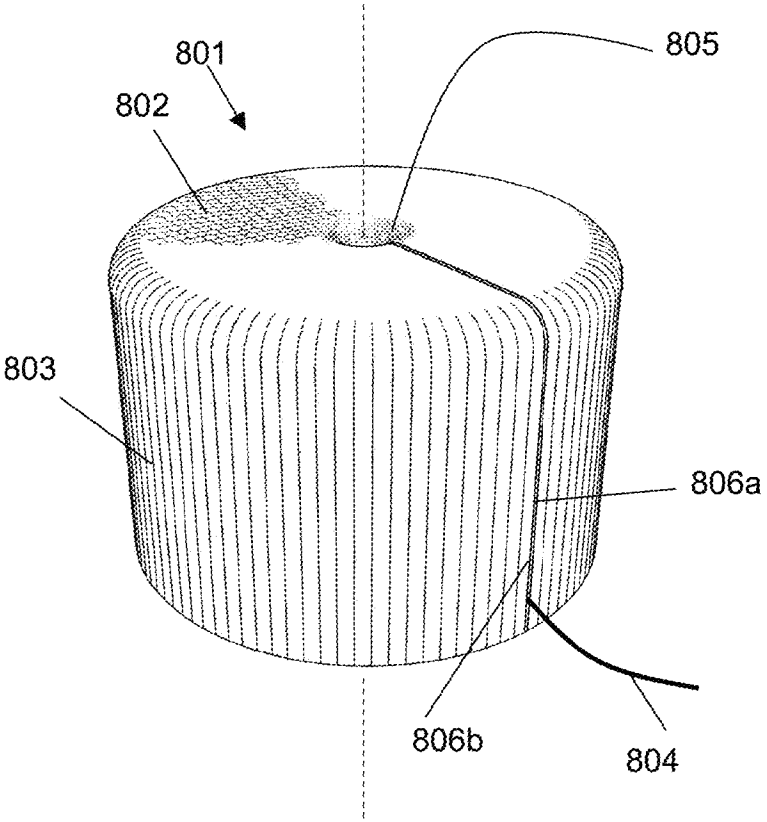
FIG. 8 is a perspective view of a lighting device showing a flexible shroud in an expanded configuration, according to another example embodiment.

Turning to FIGS. 8 and 9, another example embodiment of a lighting device 801 is shown in which the end frames 806*a*, 806*b* of the flexible shroud 803 are more rectangular-shaped. The expanded circular state is shown in FIG. 8 and the collapsed state is shown in FIG. 9.

Channels 802 are defined in the flexible shroud, which travel up and down in a parallel manner to each other. For example, when a person looks from a top-down view at the lighting device 801, they can see down into the channels 802. The person will not see the light elements.

As better shown in FIG. 9 in the collapsed stated of the lighting device 801, the end frames and the flexible shroud have a cavity 812 defined therein by the internal walls 813. In the collapsed state, the compressed flexible shroud 803' and the compressed channels 802' take up less volume. Also better shown in FIG. 9 is the light board 808, which includes a main board 809 with tabs 810 that are attached to the end frame 806*a*. Lighting elements 811 are on both sides of the light board. A wire 804 extends from the light board.

FIG. 9 also shows example fasteners 807 that are used to removably join the end frames 806*a*, 806*b* together.

Figure 10:
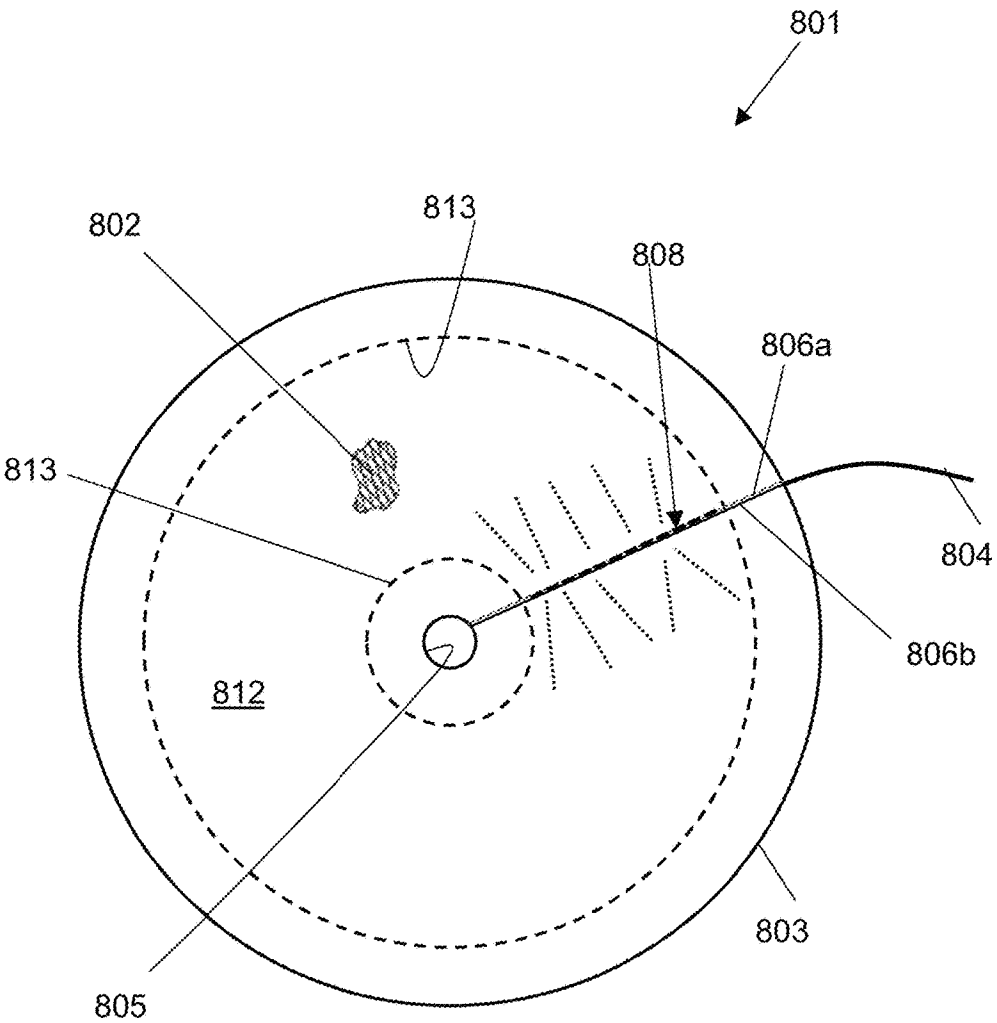
FIG. 10 is a top-down view of the lighting device of FIG. 8 showing the flexible shroud in an expanded position, and further showing the internal cavity and the light board illustrated with hidden lines.

FIG. 10 shows a top-down view of the lighting device 801, which shows a portion of the channels 802 that allow a person to look through the lighting device. The inner wall 805, also shown slightly in the perspective view in FIG. 8, is better seen in FIG. 10. In the expanded circular configuration, the inner wall 805 defines an inner cylindrical space that is centered along the vertical axis of the lighting device 801.

The internal sidewalls 813 that extend between the end frames 806*a*, 806*b* are shown in FIG. 10 as hidden lines. These internal side walls 813 define the internal cavity 812, which is also shown here to be in a continuous and unblocked circular configuration.

As can be seen, when a person looks through the voids of the channels 802 from the top-down view, the person cannot see the light board 808. The width of light board 808 is partially or fully occluded by the width of the two end frames 806*a*, 806*b* that are joined together. In an example aspect, the flexible shroud material adjoined to the end frames also occlude the light board.

Figure 11:
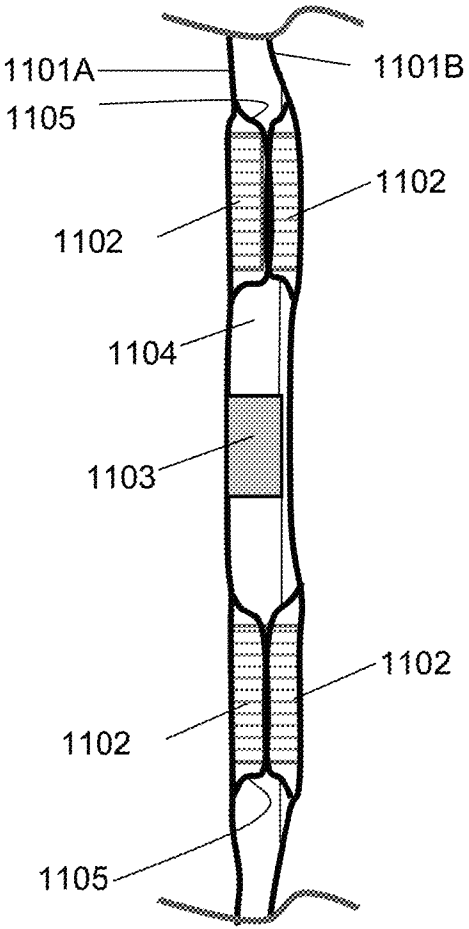
FIG. 11 is a cross-section view of a portion of two end frames that are connected together using fasteners and with a tab of a light board sandwiched between the two end frames, according to an example embodiment.

FIG. 11 shows a portion of example cross-section where a first end frame 1101A is connected to a second end frame

1101B. A light board 1104 is connected via tabs 1103 to the first end frame 1101A. The tab 1103 is offset from the magnetic fasteners 1102. In the example embodiment shown, the magnetic fasteners 1102 are raised above the respective surfaces of the first end frame and the second end frame, which provides some space for the tabs to be sandwiched therebetween the end frames. Also shown in FIG. 11 are the slight undulations in the first and the second end frames. In an example aspect, the flexible material of the end frames undulates due to the pulling forces of the magnetic fasteners at different points on the end frames. These help to provide a thin seam that occludes the view of the tabs and the light board itself.

In the example shown in FIG. 11, flexible coverings 1105 respectively cover each of the magnetic fasteners 1102 and each of the flexible coverings are adhered to the end frame at the edge of the flexible covering. For example, the flexible covering is used to help hold the magnetic fastener in place.

In other example embodiments in which the magnetic fasteners are flush with the surface of the first end frame and the second end frame, the end frames are made of a flexible material that is able to curve around the tabs.

Figure 12:
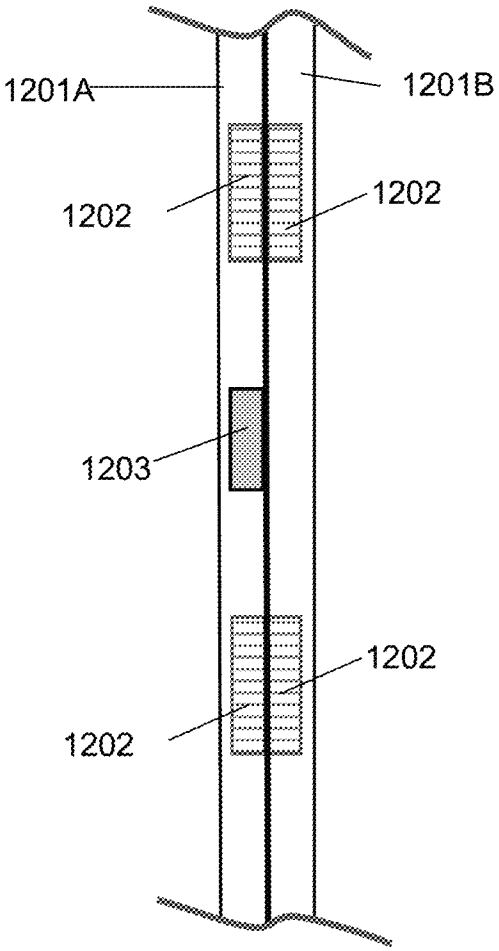
FIG. 12 is a cross-section view of a portion of two end frames that are connected together using fasteners and with a tab of a light board sandwiched between the two end frames, according to another example embodiment.

FIG. 12 shows another example embodiment of a portion of a cross-section where a first end frame 1201A is connected to a second end frame 1201B. Magnetic fasteners 1202 are embedded within the respective end frames to create a flush surface with the end frames. A tab 1203 of a light board (not visible in this view) is also embedded in the first end frame 1201A as the light board is attached to the first end frame. This creates a thin seam when the end frames are connected together, which also occludes the tab and the light board. In this example, the end frames 1201A and 1201B are rigid or semi-rigid.

In another example, not shown, one of the end frames is rigid and the other end frame is flexible and is able to undulate around any raised surfaces to form a thin seam. This helps to occlude the tabs and the light board.

Other configurations that hide the tab and the overall light board when the two end frames are connected together are applicable to the principles described herein.

Figure 14:
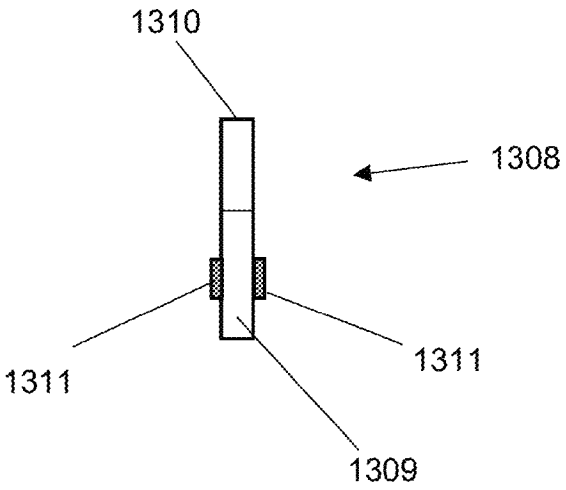
FIG. 14 is a top-down view of the light board shown in FIG. 13.
Figure 13:
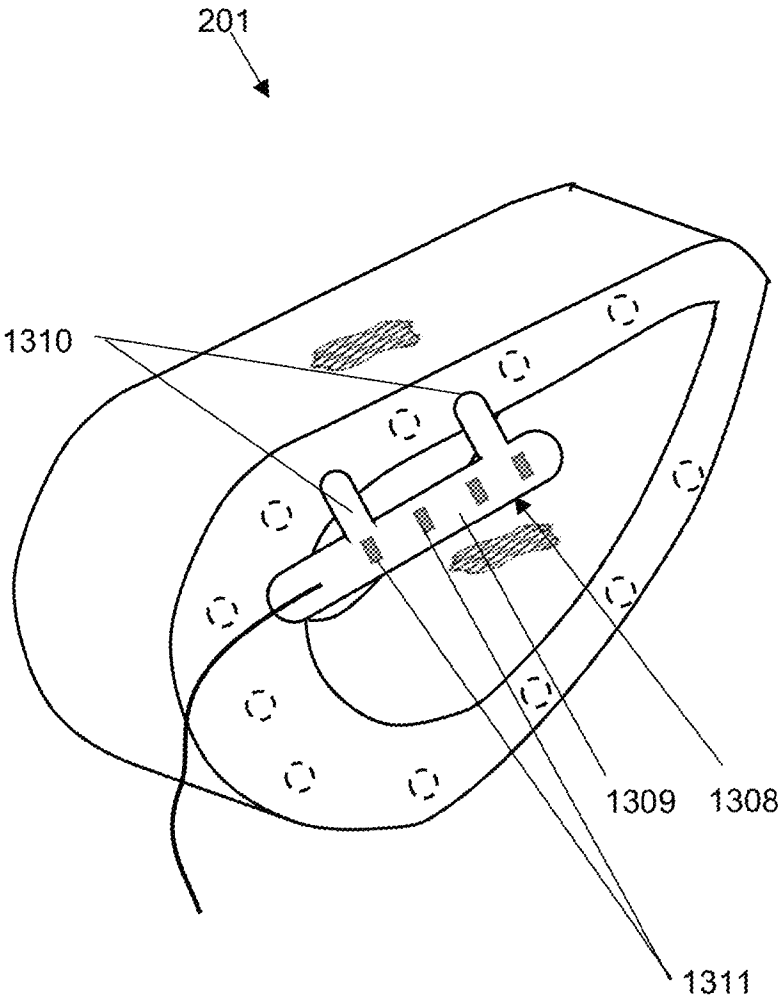
FIG. 13 is a perspective view of another example embodiment of a lighting device shown in a collapsed configuration.

FIG. 13 shows a lighting device 201 that is in a collapsed configuration, but with a different example embodiment of a light board 1308. FIG. 14 shows the light board 1308 in isolation from a top view. The light board 1308 includes a main body 1309 and tabs 1310 to attach to an end frame. Light elements 1311 are also positioned on both of the opposite facing major faces of the main body 1309.

Figure 16:
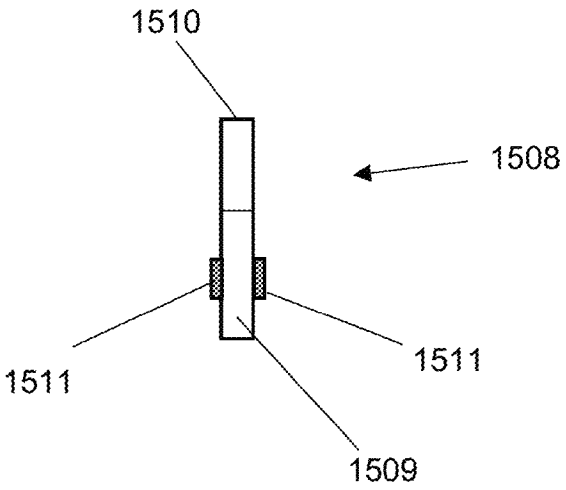
FIG. 16 is a top-down view of the light board shown in FIG. 15.
Figure 15:
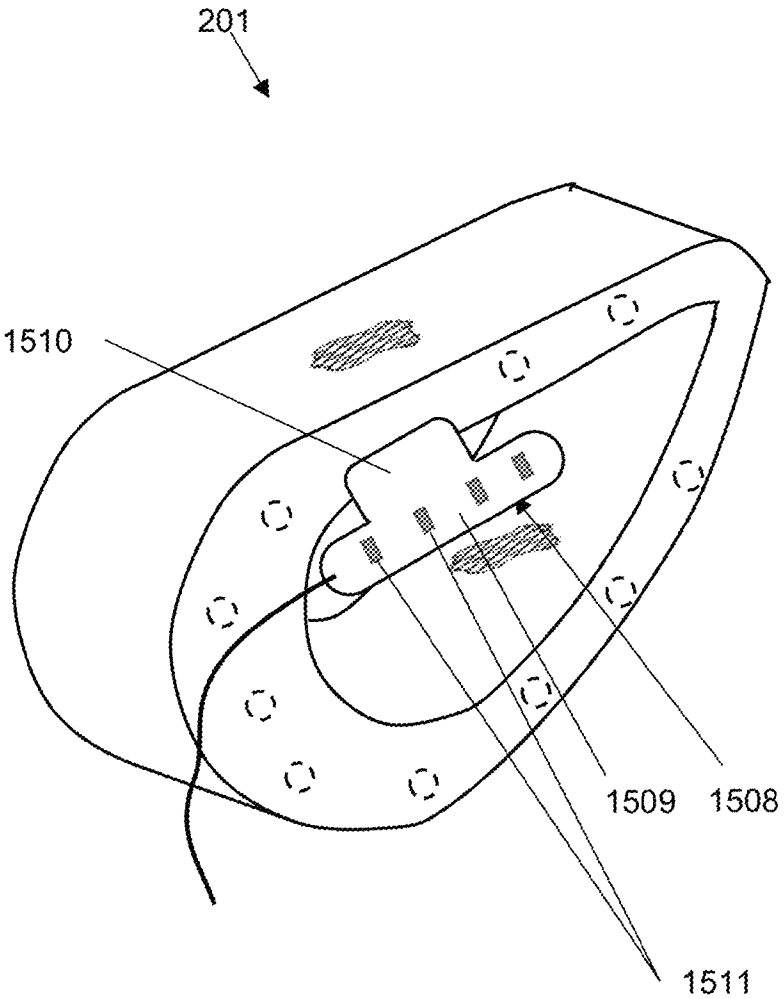
FIG. 15 is a perspective view of another example embodiment of a lighting device shown in a collapsed configuration.

FIG. 15 shows a lighting device 201 that is in a collapsed configuration, but with a different example embodiment of a light board 1508. FIG. 16 shows the light board 1508 in isolation from a top view. The light board 1508 includes a tab 1510 that connects to the end frame, and a main body 1509 with lighting elements 1511 positioned on both of its major faces.

Figure 17:
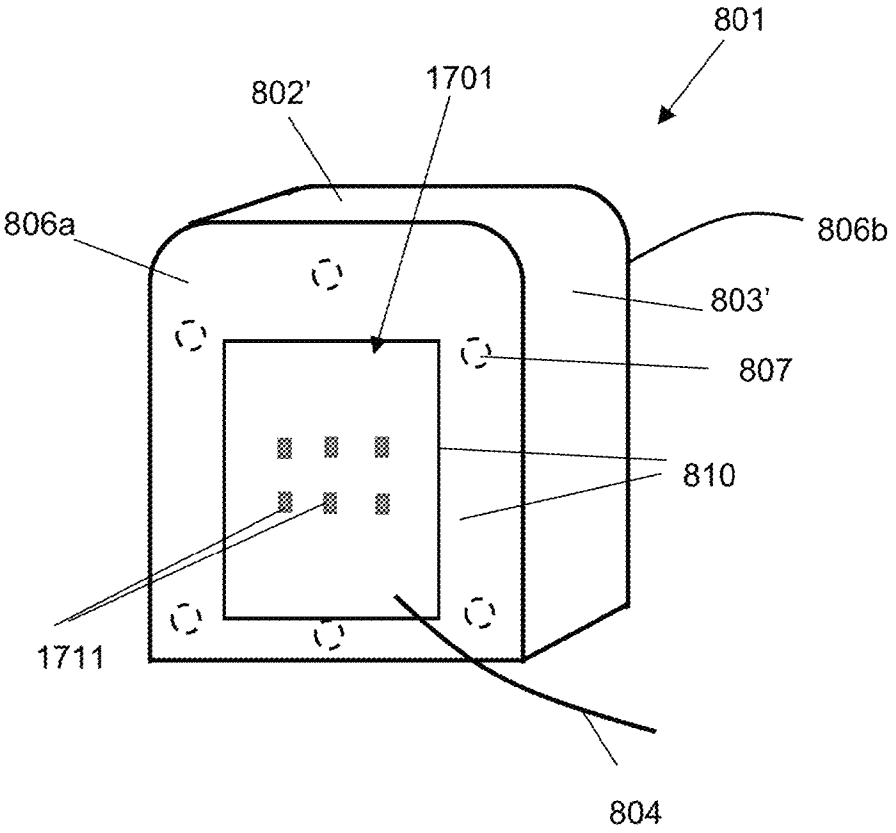
FIG. 17 is a lighting device that is similar to the lighting device shown in FIG. 9 in the collapsed view, but with a different example embodiment of a lighting board.

FIG. 17 shows a lighting device 801 with a different example embodiment of a light board 1701 that has at least one lighting element 1711 positioned on each of its opposite facing major faces, although only one major face is shown in this view. The light board 1708 covers the entire opening defined in the end frame 806*a*. As can be seen in this embodiment of the light board 1701, there are no tabs.

Figure 18:
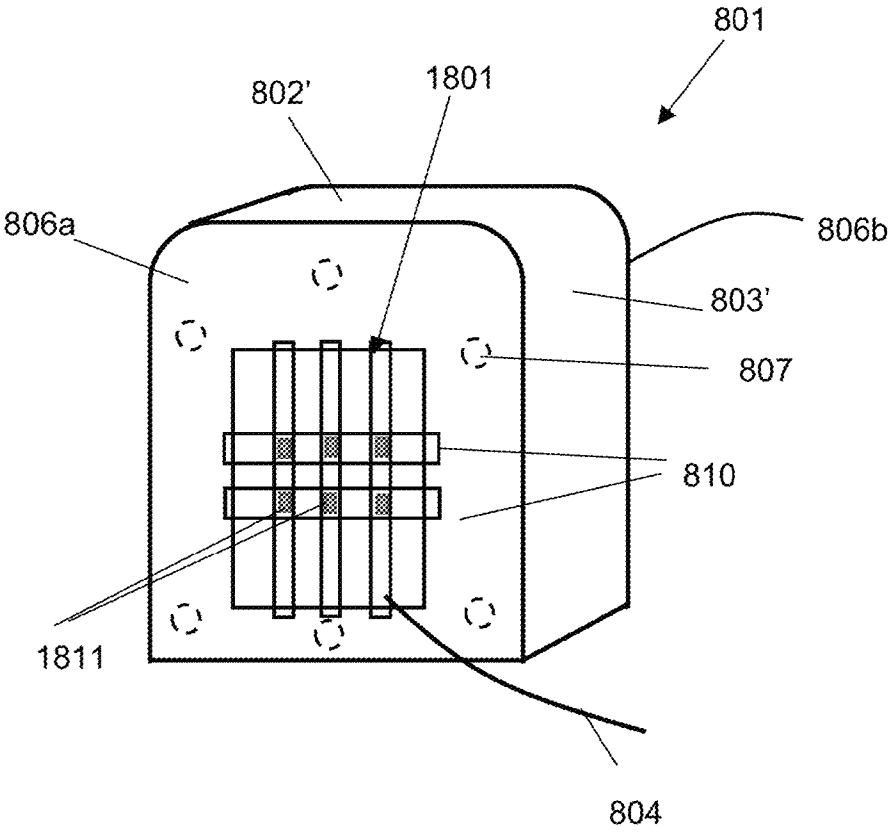
FIG. 18 is a lighting device that is similar to the lighting device shown in FIG. 9 in the collapsed view, but with a different example embodiment of a light holding structure.

FIG. 18 shows a lighting device 801 with a different example embodiment of a light mesh 1801 that has one or more lighting elements 1811 that can emit light in different directions within the cavity of the lighting device. The mesh 1801, for example, is made of wires, string, or fabric and holds the lights in position at the opening of the cavity. The ends of the mesh are attached to the end frame 806*a*, so as to be taught and hold the light elements in place. The mesh is co-planar with the end frame 806*a*. The mesh is an example of a light holding structure, as is the light board another example of a light holding structure. It will be appreciated that the light holding structure can vary in shape, material, rigidity and flexibility. It will also be appreciated that there are different ways for attaching the light holding structure to the end frame.

Below are general example embodiments and example features of the embodiments.

In a general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration; and a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame.

In an example aspect, the light board comprises at least one lighting element on a first major surface of the light board and at least one lighting element on a second major surface of the light board, the first and the second major surfaces facing oppositely away from each other.

In another example aspect, the light board comprises a main body and one or more tabs that extend from the main body, the one or more tabs attached to the one of the first frame and the second frame.

In another example aspect, the first end frame and the second end frame each comprise a flexible material that undulates around the one or more tabs of the light board.

In another example aspect, the main body of the light board comprises first and second opposite facing major faces, and at least one lighting element is positioned on each one of the first and the second opposite facing major faces.

In another example aspect, at least one of the first end frame and the second end frame comprise one more fasteners to removably connect the first end frame to the second end frame, and the one or more tabs and the one or more fasteners have different and non-overlapping positions from each other.

In another example aspect, there are at least two fasteners, and at least one of the tabs is positioned between two given fasteners on the one of the first end frame and the second end frame.

In another example aspect, the one or more fasteners comprises one or more magnets.

In another example aspect, the one or more fasteners include hooks and loops.

In another example aspect, the one or more fasteners comprise mushroom-shaped heads that interlock with each other.

In another example aspect, there is at least one fastener on the first end frame and at least one fastener on the second end frame, and these fasteners are raised above respective surfaces of the first end frame and the second end frame.

In another example aspect, a wire extends from the light board and out between a seam formed by the first frame and the second frame joined to each other.

In another example aspect, the light board comprises one or more batteries to power the one or more lighting elements.

In another example aspect, in the circular configuration with the first end frame and the second end framed connected, the light board is coplanar with the one of the first end frame and the second end frame.

In another example aspect, in the circular configuration with the first end frame and the second end frame connected, the light board is in a plane that is parallel to at least a plane of the first end frame and a plane of the second frame.

In another example aspect, the light board is rigid.

In another example aspect, the light board is semi-rigid.

In another example aspect, the flexible shroud comprises a cellular structure having multiple channels.

In another example aspect, the flexible shroud comprises multiple apertures.

In another example aspect, at least one of the first end frame and the second end frame is rigid.

In another example aspect, at least one of the first end frame and the second end frame is flexible.

In another example aspect, the light board partially covers the opening of the attached one of the first end frame and the second end frame.

In another example aspect, the light board fully covers the opening of the attached one of the first end frame and the second end frame.

In another general example embodiment, a lighting device includes: a flexible shroud comprising a cellular structure with channels, and a first end frame and a second end frame at opposite ends of the cellular structure that extend the cellular structure when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud around a central vertical axis with the internal cavity extending in the circular configuration; a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame and is co-planar with the first end frame and the second end frame.

In an example aspect, the light board comprises at least one lighting element one a first major surface of the light board and at least one lighting element on a second major surface of the light board, the first and the second major surfaces facing oppositely away from each other.

In another example aspect, the light board comprises a main body and one or more tabs that extend from the main body, the one or more tabs attached to the one of the first frame and the second frame.

In another example aspect, the first end frame and the second end frame each comprise a flexible material that undulates around the one or more tabs of the light board.

In another example aspect, the main body of the light board comprises first and second opposite facing major faces, and at least one lighting element is positioned on each one of the first and the second opposite facing major faces.

In another example aspect, at least one of the first end frame and the second end frame comprise one more fasteners to removably connect the first end frame to the second end frame, and the one or more tabs and the one or more fasteners have different and non-overlapping positions from each other.

In another example aspect, the one or more fasteners comprises one or more magnets.

In another example aspect, the one or more fasteners include hooks and loops.

In another example aspect, the one or more fasteners comprise mushroom-shaped heads that interlock with each other.

In another example aspect, there are at least two fasteners on at least the first end frame, and at least one of the one or more tabs is positioned between two given fasteners.

In another example aspect, there are at least two fasteners on at least the second end frame, and at least one of the one or more tabs is positioned between two given fasteners.

In another example aspect, there is at least one fastener on the first end frame and at least one fastener on the second end frame, and these fasteners are raised above respective surfaces of the first end frame and the second end frame.

In another example aspect, a wire extends from the light board and out between a seam formed by the first frame and the second frame joined to each other.

In another example aspect, the light board comprises one or more batteries to power the one or more lighting elements.

In another example aspect, the light board partially covers the opening of the attached one of the first end frame and the second end frame.

In another example aspect, the light board fully covers the opening of the attached one of the first end frame and the second end frame.

In another general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration; a light board attached to one of the first end frame and the second end frame and at least partially covering the opening of the one of the first end frame and the second end frame, and the light board comprises one or more lighting elements, and wherein, in the circular configuration, the light board is sandwiched between the first end frame and the second end frame; and wherein the light board comprises a main body and tabs that extend from the main body, the tabs are attached to the one of the first frame and the second frame, and the first end frame and the second end frame each comprise a flexible material that undulates around the tabs of the light board.

In an example aspect, the main body of the light board comprises first and second opposite facing major faces, and at least one lighting element is positioned on each one of the first and the second opposite facing major faces.

In another example aspect, at least one of the first end frame and the second end frame comprise fasteners to removably connect the first end frame to the second end frame, and the tabs and the fasteners have different and non-overlapping positions from each other.

In another example aspect, at least one of the tabs is positioned between two fasteners on the one of the first end frame and the second end frame.

In another example aspect, fasteners comprise magnets.

In another example aspect, the fasteners are raised above respective surfaces of the first end frame and the second end frame.

In another general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration; a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame; and wherein the light board comprises a main body and one or more tabs that extend from the main body, the one or more tabs are attached to the attached one of the first frame and the second frame and the main body comprises first and second opposite facing major faces, and at least one lighting element is positioned on each one of the first and the second opposite facing major faces.

In an example aspect, in the circular configuration with the first end frame and the second end framed connected, the light board is coplanar with the one of the first end frame and the second end frame.

In another example aspect, in the circular configuration with the first end frame and the second end frame connected, the light board is in a plane that is parallel to at least a plane of the first end frame and a plane of the second frame.

In another example aspect, the light board is rigid.

In another example aspect, the light board is semi-rigid.

In another example aspect, the flexible shroud comprises a cellular structure having multiple channels.

In another example aspect, the flexible shroud comprises multiple apertures.

In another example aspect, the first end frame and the second end frame are rigid and the one or more tabs are embedded into the attached one of the first end frame and the second end frame.

In another example aspect, the first end frame and the second end frame are flexible, and, in the circular configuration, the first and the second end frames undulate around the one or more tabs.

In another general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration; a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame; and wherein the light board comprises a main body and tabs that extend from the main body the tabs are attached to the one of the first frame and the second frame, both the first end frame and the second end frame comprise magnets to removably connect the first end frame to the second end frame, the tabs and the magnets have different and non-overlapping positions from each other, and, in the circular configuration, the tabs and the main body are hidden from view by the first end frame and the second end frame connected to each other by the magnets.

In an example aspect, in the circular configuration with the first end frame and the second end framed connected, the light board is coplanar with the one of the first end frame and the second end frame.

In another example aspect, in the circular configuration with the first end frame and the second end frame connected, the light board is in a plane that is parallel to at least a plane of the first end frame and a plane of the second frame.

In another example aspect, the light board is rigid.

In another example aspect, the light board is semi-rigid.

In another example aspect, the flexible shroud comprises a cellular structure having multiple channels.

In another example aspect, the flexible shroud comprises multiple apertures.

In another example aspect, the first end frame and the second end frame are rigid and the tabs are embedded into the attached one of the first end frame and the second end frame.

In another example aspect, the first end frame and the second end frame are flexible, and, in the circular configuration, the first and the second end frames undulate around the tabs.

In another general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity continuously extends in the circular configuration; a light board attached to one of the first end frame and the second end frame and only partially covering the opening of the attached one of the first end frame and the second end frame, and the light board comprises one or more lighting elements, and wherein, in the circular configuration, the light board is sandwiched between the first end frame and the second end frame; and the light board comprises at least one lighting element on a first major surface of the light board and at least one lighting element on a second major surface of the light board, the first and the second major surfaces facing oppositely away from each other.

In an example aspect, in the circular configuration with the first end frame and the second end framed connected, the light board is coplanar with the one of the first end frame and the second end frame.

In another example aspect, in the circular configuration with the first end frame and the second end frame connected, the light board is in a plane that is parallel to at least a plane of the first end frame and a plane of the second frame.

In another example aspect, the light board is rigid.

In another example aspect, the light board is semi-rigid.

In another example aspect, the flexible shroud comprises a cellular structure having multiple channels.

In another example aspect, the flexible shroud comprises multiple apertures.

In another example aspect, the light board comprises one or more tabs, wherein the first end frame and the second end frame are rigid, and the one or more tabs are embedded into the attached one of the first end frame and the second end frame.

In another example aspect, the light board comprises one or more tabs that are attached to the attached one of the first end frame and the second end frame, wherein the first end frame and the second end frame are flexible, and, in the circular configuration, the first and the second end frames undulate around the one or more tabs.

In another general example embodiment, a lighting device includes: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud, with the internal cavity extending in the circular configuration; a light board attached to one of the first end frame and the second end frame and fully covering the opening of the attached one of the first end frame and the second end frame, and the light board comprises one or more lighting elements, and wherein, in the circular configuration, the light board is sandwiched between the first end frame and the second end frame and divides the internal cavity that extends in the circular configuration; and wherein the light board comprises at least one lighting element on a first major surface of the light board and at least one lighting element on a second major surface of the light board, the first and the second major surfaces facing oppositely away from each other.

In an example aspect, in the circular configuration with the first end frame and the second end framed connected, the light board is coplanar with the one of the first end frame and the second end frame.

In another example aspect, in the circular configuration with the first end frame and the second end frame connected, the light board is in a plane that is parallel to at least a plane of the first end frame and a plane of the second frame.

In another example aspect, the light board is rigid.

In another example aspect, the light board is semi-rigid.

In another example aspect, the flexible shroud comprises a cellular structure having multiple channels.

In another example aspect, the flexible shroud comprises multiple apertures.

In another example aspect, the light board comprises one or more tabs, wherein the first end frame and the second end frame are rigid, and the one or more tabs are embedded into the attached one of the first end frame and the second end frame.

In another example aspect, the light board comprises one or more tabs that are attached to the attached one of the first end frame and the second end frame, wherein the first end frame and the second end frame are flexible, and, in the circular configuration, the first and the second end frames undulate around the one or more tabs.

In another example embodiment, a lighting device is provided that comprises: a flexible shroud with a first end frame and a second end frame at opposite at opposite ends that can extend when pulled away from each other; an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity continuously extending in the circular configuration; a light holding structure attached to one of the first end frame and the second end frame and at least partially covering the opening of the attached one of the first end frame and the second end frame, the light holding structure comprising a flexible material and having a thin side profile, and the light holding structure holds in position one or more lighting elements within the opening of the one of the first end frame and the second end frame; and wherein, in the circular configuration, the light holding structure is sandwiched between the first end frame and the second end frame.

In an example aspect, the light holding structure comprises a mesh. In another example aspect, the light holding structure comprises wire. In another example aspect, the light holding structure comprises string. In another example aspect, the light holding structure comprises fabric.

In another example aspect, the light holding structure partially covers the opening of the attached one of the first end frame and the second end frame.

Various features described herein from different example embodiments can be combined together, although such combinations have not been explicitly described.

It will be appreciated that the particular example embodiments shown in the figures and described above are for illustrative purposes only and many other variations can be used according to the example embodiments described herein. Although the above has been described with reference to specific example embodiments, various modifications thereof will be apparent to those skilled in the art as outlined in the appended claims.

The invention claimed is:

1. A lighting device comprising:

a flexible shroud comprising a cellular structure with channels, and a first end frame and a second end frame at opposite ends of the cellular structure that extend the cellular structure when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud around a central vertical axis with the internal cavity extending in the circular configuration;

a light board attached to one of the first end frame and the second end frame and at least partially covering the opening of the attached one of the first end frame and the second end frame, and the light board comprises a first and a second opposite facing major face that each have thereon one or more lighting elements, and wherein, in the circular configuration, the light board is sandwiched between the first end frame and the second end frame and is co-planar with the first end frame and the second end frame.

2. The lighting device of claim 1 wherein the light board comprises a main body and one or more tabs that extend from the main body, the one or more tabs attached to the one of the first frame and the second frame.

3. The lighting device of claim 2 wherein the first end frame and the second end frame each comprise a flexible material that undulates around the one or more tabs of the light board.

4. The lighting device of claim 2 wherein at least one of the first end frame and the second end frame comprise one more fasteners to removably connect the first end frame to the second end frame, and the one or more tabs and the one or more fasteners have different and non-overlapping positions from each other.

5. The lighting device of claim 4 wherein the one or more fasteners comprises one or more magnets.

6. The lighting device of claim 4 wherein the one or more fasteners include hooks and loops.

7. The lighting device of claim 4 wherein the one or more fasteners comprise mushroom-shaped heads that interlock with each other.

8. The lighting device of claim 4 wherein there are at least two fasteners on at least the first end frame, and at least one of the one or more tabs is positioned between two given fasteners.

9. The lighting device of claim 4 wherein there are at least two fasteners on at least the second end frame, and at least one of the one or more tabs is positioned between two given fasteners.

10. The lighting device of claim 4 comprising at least one fastener on the first end frame and at least one fastener on the second end frame, and these fasteners are raised above respective surfaces of the first end frame and the second end frame.

11. The lighting device of claim 1 wherein the light board partially covers the opening of the attached one of the first end frame and the second end frame.

12. The lighting device of claim 1 wherein the light board fully covers the opening of the attached one of the first end frame and the second end frame.

13. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration;

a light board attached to one of the first end frame and the second end frame and at least partially covering the opening of the one of the first end frame and the second end frame, and the light board comprises one or more lighting elements, and wherein, in the circular configuration, the light board is sandwiched between the first end frame and the second end frame;

wherein the light board comprises a main body and tabs that extend from the main body, the tabs are attached to the one of the first frame and the second frame, and the first end frame and the second end frame each comprise a flexible material that undulates around the tabs of the light board.

14. The lighting device of claim 13 wherein the main body of the light board comprises first and second opposite facing major faces, and at least one lighting element is positioned on each one of the first and the second opposite facing major faces.

15. The lighting device of claim 13 wherein at least one of the first end frame and the second end frame comprise fasteners to removably connect the first end frame to the second end frame, and the tabs and the fasteners have different and non-overlapping positions from each other.

16. The lighting device of claim 13 wherein at least one of the tabs is positioned between two fasteners on the one of the first end frame and the second end frame.

17. The lighting device of claim 16 wherein the fasteners comprises magnets.

18. The lighting device of claim 16 wherein the fasteners are raised above respective surfaces of the first end frame and the second end frame.

19. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration;

a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame; and wherein the light board comprises a main body and one or more tabs that extend from the main body, the one or more tabs are attached to the attached one of the first frame and the second frame and the main body comprises first and second opposite facing major faces, and at least one lighting element is positioned on each one of the first and the second opposite facing major faces.

20. The lighting device of claim 19 wherein, in the circular configuration with the first end frame and the second end framed connected, the light board is coplanar with the one of the first end frame and the second end frame.

21. The lighting device of claim 19 wherein the first end frame and the second end frame are rigid and the one or more tabs are embedded into the attached one of the first end frame and the second end frame.

22. The lighting device of claim 19 wherein the first end frame and the second end frame are flexible, and, in the circular configuration, the first and the second end frames undulate around the one or more tabs.

23. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity extending in the circular configuration;

a light board attached to one of the first end frame and the second end frame and at least partially covering the opening of the attached one of the first end frame and the second end frame, and the light board comprises one or more lighting elements, and wherein, in the circular configuration, the light board is sandwiched between the first end frame and the second end frame; and wherein the light board comprises a main body and tabs that extend from the main body the tabs are attached to the one of the first frame and the second frame, both the first end frame and the second end frame comprise magnets to removably connect the first end frame to the second end frame, the tabs and the magnets have different and non-overlapping positions from each other, and, in the circular configuration, the tabs and the main body are hidden from view by the first end frame and the second end frame connected to each other by the magnets.

24. The lighting device of claim 23 wherein, in the circular configuration with the first end frame and the second end framed connected, the light board is coplanar with the one of the first end frame and the second end frame.

25. The lighting device of claim 23 wherein the first end frame and the second end frame are rigid and the tabs are embedded into the attached one of the first end frame and the second end frame.

26. The lighting device of claim 23 wherein the first end frame and the second end frame are flexible, and, in the circular configuration, the first and the second end frames undulate around the tabs.

27. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity continuously extending in the circular configuration;

a light board attached to one of the first end frame and the second end frame and only partially covering the opening of the attached one of the first end frame and the second end frame, and the light board comprises one or more lighting elements, and wherein, in the circular configuration, the light board is sandwiched between the first end frame and the second end frame; and the light board comprises at least one lighting element on a first major surface of the light board and at least one lighting element on a second major surface of the light board, the first and the second major surfaces facing oppositely away from each other.

28. The lighting device of claim 27 wherein, in the circular configuration with the first end frame and the second end framed connected, the light board is coplanar with the one of the first end frame and the second end frame.

29. The lighting device of claim 27 wherein the light board comprises one or more tabs, wherein the first end frame and the second end frame are rigid, and the one or more tabs are embedded into the attached one of the first end frame and the second end frame.

30. The lighting device of claim 27 wherein the light board comprises one or more tabs that are attached to the attached one of the first end frame and the second end frame, wherein the first end frame and the second end frame are flexible, and, in the circular configuration, the first and the second end frames undulate around the one or more tabs.

31. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud, with the internal cavity extending in the circular configuration;

a light board attached to one of the first end frame and the second end frame and fully covering the opening of the attached one of the first end frame and the second end frame, and the light board comprises one or more lighting elements, and wherein, in the circular configuration, the light board is sandwiched between the first end frame and the second end frame and divides the internal cavity that extends in the circular configuration; and wherein the light board comprises at least one lighting element on a first major surface of the light board and at least one lighting element on a second major surface of the light board, the first and the second major surfaces facing oppositely away from each other.

32. The lighting device of claim 31 wherein, in the circular configuration with the first end frame and the second end framed connected, the light board is coplanar with the one of the first end frame and the second end frame.

33. The lighting device of claim 31 wherein the light board comprises one or more tabs, wherein the first end frame and the second end frame are rigid, and the one or more tabs are embedded into the attached one of the first end frame and the second end frame.

34. The lighting device of claim 31 wherein the light board comprises one or more tabs that are attached to the attached one of the first end frame and the second end frame, wherein the first end frame and the second end frame are flexible, and, in the circular configuration, the first and the second end frames undulate around the one or more tabs.

35. A lighting device comprising:

a flexible shroud with a first end frame and a second end frame at opposite ends that can extend when pulled away from each other;

an internal cavity defined in the body of flexible shroud extending transversely from an opening defined in the first end frame to an opening defined in the second end frame, and the first end frame and the second end frame are removably connectable to each other to form a circular configuration of the flexible shroud with the internal cavity continuously extending in the circular configuration;

a light holding structure attached to one of the first end frame and the second end frame and at least partially covering the opening of the attached one of the first end frame and the second end frame, the light holding structure comprising a flexible material and having a thin side profile, and the light holding structure holds in position one or more lighting elements within the opening of the one of the first end frame and the second end frame; and in the circular configuration, the light holding structure is sandwiched between the first end frame and the second end frame.

36. The lighting device of claim 35 wherein the light holding structure comprises a mesh.

37. The lighting device of claim 36 wherein the light holding structure comprises wire.

38. The lighting device of claim 36 wherein the light holding structure comprises string.

39. The lighting device of claim 36 wherein the light holding structure comprises fabric.

40. The lighting device of claim 35 wherein the light holding structure partially covers the opening of the attached one of the first end frame and the second end frame.

* * * * *